US009520115B2

(12) United States Patent
Byars

(10) Patent No.: US 9,520,115 B2
(45) Date of Patent: Dec. 13, 2016

(54) DRUM SLIP

(71) Applicant: Cassidy Howell Byars, Philadelphia, MS (US)

(72) Inventor: Cassidy Howell Byars, Philadelphia, MS (US)

( * ) Notice: Subject to any disclaimer, the term of this patent is extended or adjusted under 35 U.S.C. 154(b) by 701 days.

(21) Appl. No.: 13/718,900

(22) Filed: Dec. 18, 2012

(65) Prior Publication Data

US 2014/0166182 A1 Jun. 19, 2014

(51) Int. Cl.
*G10D 13/02* (2006.01)

(52) U.S. Cl.
CPC ..... *G10D 13/028* (2013.01); *Y10T 29/49574* (2015.01); *Y10T 156/10* (2015.01)

(58) Field of Classification Search
CPC ..... G10D 13/026; G10D 13/02; G10D 13/00; G10D 13/028; G10D 3/00; G10G 5/00
USPC ..... 84/421, 411 R
See application file for complete search history.

(56) References Cited

U.S. PATENT DOCUMENTS

| | | | | |
|---|---|---|---|---|
| 621,730 | A | 3/1899 | Wilmot | |
| 1,377,411 | A | 5/1921 | Douglas | |
| 1,794,212 | A | 2/1931 | Snyder | |
| 2,850,156 | A | 9/1958 | Shane | |
| 5,524,756 | A | 6/1996 | Sutherland | |
| 2003/0136243 | A1* | 7/2003 | Bourgoin | 84/411 R |
| 2005/0197219 | A1 | 9/2005 | Casasanta, Jr. | |
| 2008/0260194 | A1 | 10/2008 | Pooley | |

FOREIGN PATENT DOCUMENTS

| | | | | |
|---|---|---|---|---|
| GB | 2467372 A * | 8/2010 | G10D 13/02 | 84/411 R |

* cited by examiner

*Primary Examiner* — Kimberly Lockett
(74) *Attorney, Agent, or Firm* — Jeremy M. Clay

(57) ABSTRACT

An interchangeable drum slip that may be quickly installed to change the appearance of a drum and to provide protection to the drum shell. The drum slip is a rectangular piece of material that is pre-cut to precisely fit specific models of drums. Openings are cut into the material that correspond with hardware that is attached to the drum shell. A user installs the drum slip by placing the drum slip around the drum shell and securing the ends of the drum slip together. The openings in the drum slip fit over and around any hardware that is attached to the drum shell and any apertures formed in the drum shell. The ends of the drum slip are pulled together and secured with an adhesive. For some drums, the drum slip may be installed without disassembling any parts of the drum. For other drums, one or more drum heads and retaining hoops must be removed to install the drum slip. The drum slip may be transparent, and the drum slip may be made in any color and messages, designs, or information may be printed on or molded into the drum slip. Anyone can quickly and easily change drum slips to change the appearance of a drum.

8 Claims, 5 Drawing Sheets

DRUM SLIP

FIELD OF THE DISCLOSURE

Percussion instruments.

PRIORITY

This application does not claim the priority date of any other applications.

BACKGROUND OF THE INVENTION

Drums typically include a cylindrical shell or body with a head placed over one or more ends of the shell. The outer edge of the head is held against the shell with a hoop. The hoop is clamped to the shell with a series of fasteners that apply force to hold the head taught. The fasteners often comprise a set of circumferentially spaced tension rods that are connected to the outer surface of the drum body. Threaded lugs pass through a set of circumferentially spaced apertures in the hoop to engage the threaded ends of the tension rods. The lugs are adjusted to adjust the amount of tension on the drum head.

Drum shells may be made of wood, metal, acrylic, plastic, carbon fiber, or other materials. Drum shells come in a variety of finishes that may include different colors or patterns. Drum shells are subject to a great amount of wear and tear. Musicians in a marching band often carry their drums during a performance, and many musicians travel from venue to venue to play their instruments. As a result of this wear and tear, the finish of the drum shell becomes marred and needs to be repaired or refinished.

Prior art methods of refinishing drum shells include repainting the shell or adhesively applying a flexible cover material (or "wrap") to the shell. Both of these methods are undesirable because they are difficult and time consuming. To repaint a drum shell, a user must completely disassemble the drum, take necessary steps to prepare and paint the shell, and wait for the shell to dry before reassembling the drum. From beginning to end, this process may take several days.

Similarly, the user must completely disassemble the drum to apply traditional flexible cover materials. The user applies an adhesive to the drum shell and then applies the covering material to the shell. Once the adhesive cures, the drum is reassembled. Applying a traditional flexible covering material is time consuming and tedious because a user must trim the material to fit around any holes in the drum shell and around any hardware attached to the drum shell.

Accordingly, there remains a need for a drum shell cover that is easily and quickly installed and provides a musician the ability to easily and quickly change the appearance of a drum.

SUMMARY OF THE INVENTION

The drum slip overcomes the limitations associated with the prior art by providing an interchangeable drum shell cover that may be quickly and easily installed. Unlike conventional methods of painting or wrapping drums, a user is not required to completely disassemble the drum to install the drum slip, and the user is not required to spend large amounts of time waiting for paint to dry or waiting for adhesive to cure before reassembling the drum. The drum slip is a rectangular piece of material that is pre-cut to precisely fit specific models of drums. Openings are cut into the material that correspond with hardware that is attached to the drum shell.

For some drum models, the drum slip is installed by placing the drum slip around the drum shell. The openings in the drum slip fit over and around any hardware that is attached to the drum shell and any apertures formed in the drum shell. The ends of the drum slip are then pulled together and attached to one another. For other drum models, one or more drum heads must be removed to install the drum slip. For these models, a user installs the drum slip by removing the drum head and retaining hoops and placing the drum slip around the drum shell. The openings in the drum slip fit over and around any hardware that is attached to the drum shell and any apertures formed in the drum shell. The ends of the drum slip are then pulled together and attached to one another, and the drum head and retaining hoops are reinstalled.

Because complete disassembly of the drum is not required to install the drum slip, the entire installation process may be completed in just a few minutes. The drum slip may be made in any color or may even be transparent, and messages or information may be printed on or molded into the drum slip. Anyone can quickly and easily change drum slips to change the appearance of a drum. The drum slip provides a cosmetic visual enhancement of the drum, and the drum slip also serves to protect the drum shell.

DETAILED DESCRIPTION

Figure 1:
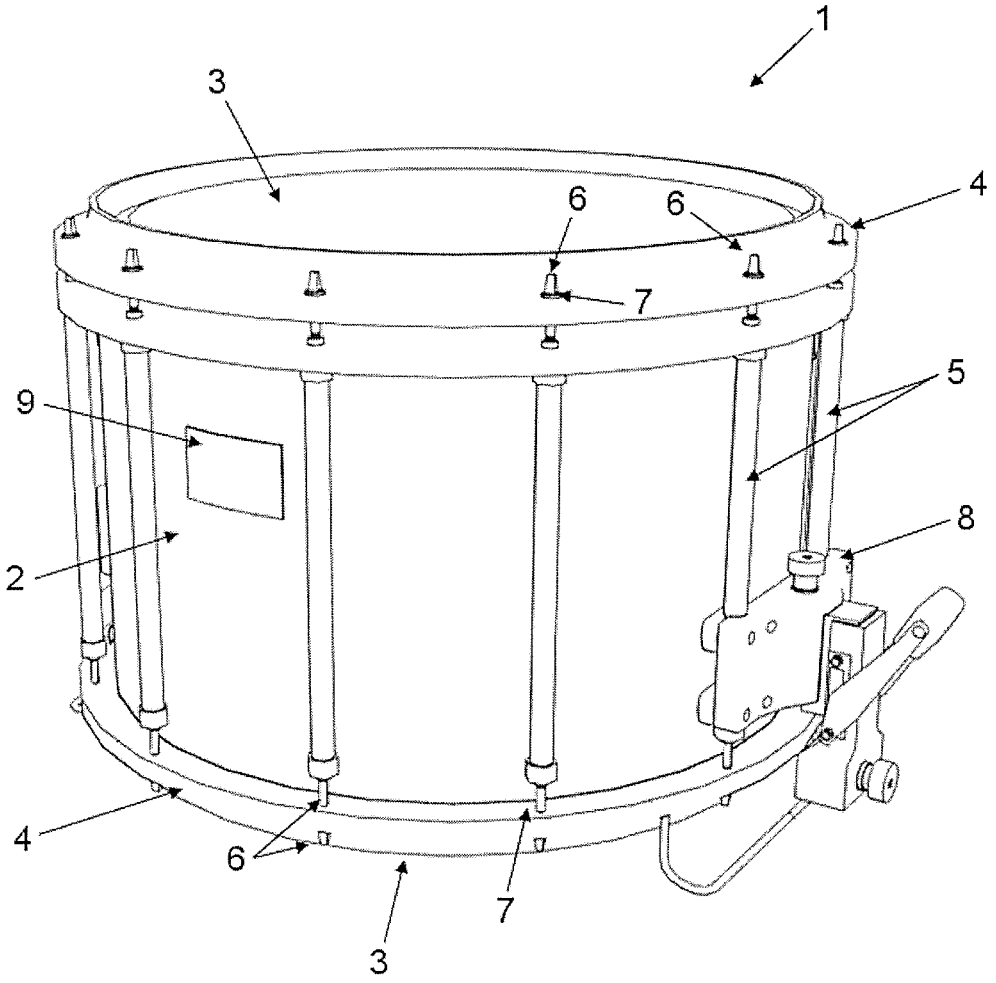
FIG. 1 is a side view of a drum.

FIG. 1 is a side view of a conventional drum 1. The drum includes a cylindrical shell 2 or body 2 with a head 3 placed over one or more ends of the shell 2. The drum 1 depicted in FIG. 1 includes a head 3 on both ends of the shell 2, but other drums 1 may only include one head 3. The outer edge of the head 3 is held against the shell 2 with a set of hoops 4. The hoops 4 are clamped to the shell 2 with a series of circumferentially spaced tension rods 5 that apply force to hold the head 3 taught. The ends of the tension rods 5 are internally threaded. Threaded lugs 6 pass through a set of circumferentially spaced apertures 7 in the hoops 4 to engage the threaded ends of the tension rods 5. The lugs 6 are adjusted to adjust the amount of tension on the drum head 3.

Other external hardware may be attached to the drum shell 2. The drum 1 depicted in FIG. 1 has a snare strainer 8 and a manufacturer's emblem 9 attached to the shell 2. Other embodiments may include other types of hardware attached to the shell, and drums 1 may also incorporate apertures in the shell (not shown) to provide attachment points for the hardware. Because there are so many pieces, completely disassembling and reassembling a drum 1 can be very difficult and time consuming.

Figure 2:
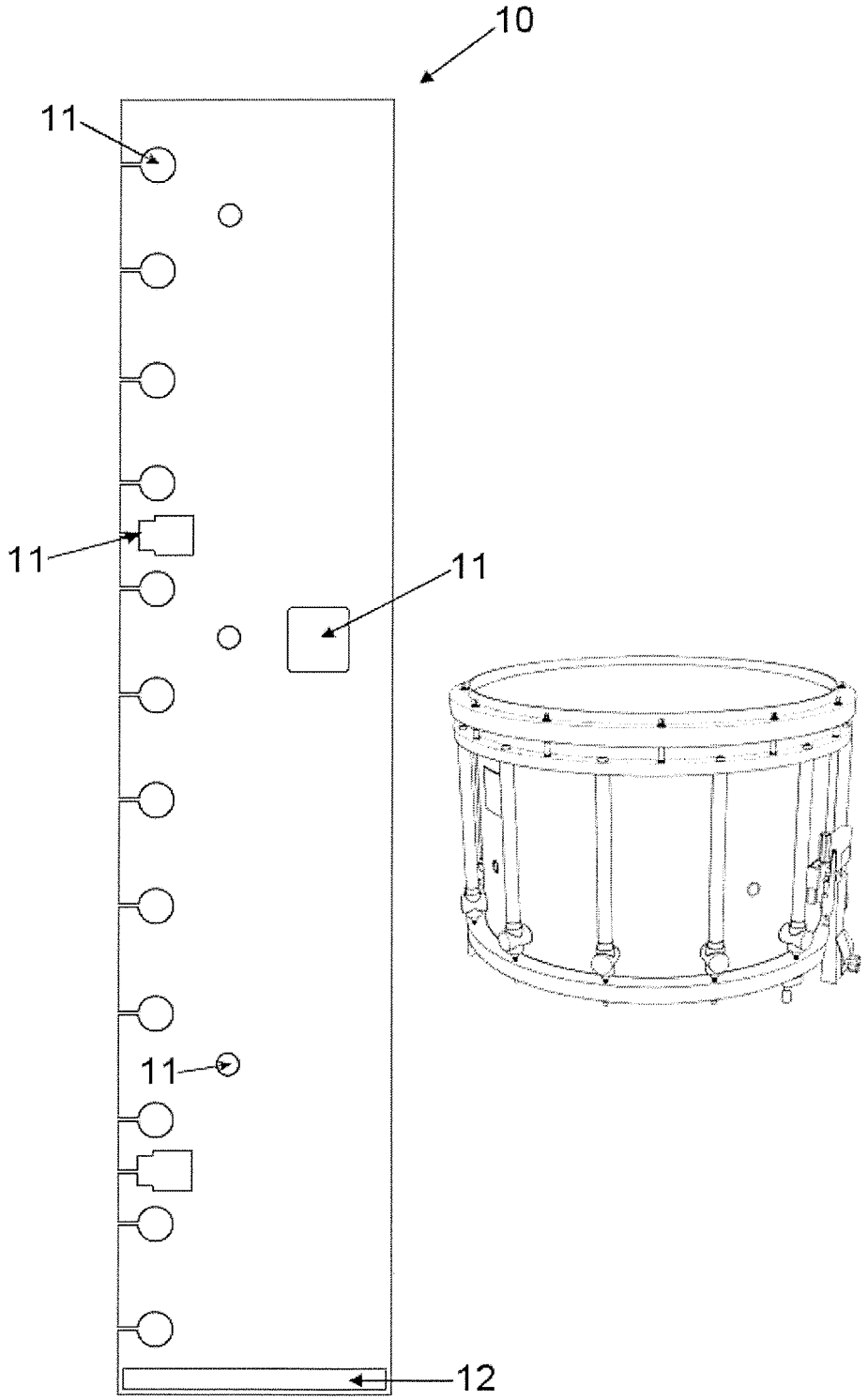
FIG. 2 is a front view of the drum slip.

FIG. 2 is a front view of the drum slip 10. The drum slip 10 comprises a rectangular piece of flexible material that is wrapped around a drum shell 2. The drum slip 10 is pre-cut to precisely fit around hardware that is attached to a drum shell 2 and to fit around any apertures formed in the drum shell 2. A series of openings 11 are cut into the drum slip 10 and are spaced to correspond to the spacing of hardware on a drum shell 2. When the drum slip 10 is wrapped around the drum shell 2, the openings 11 fit over and around hardware that is attached to the drum shell 2 and over and around any apertures formed in the drum shell 2. Because the type and location of the hardware varies from one drum 1 model to another, the shapes and locations of the drum slip's 10 openings 11 will vary depending on which model of drum 1 will be covered.

The drum slip 10 includes a means for securing the ends of the flexible material together when the drum slip 10 is wrapped around a drum shell 2. In FIG. 2, a strip of adhesive 12 is attached to one end of the drum slip 10. When the drum slip 10 is wrapped around the drum shell 2, the ends of the drum slip 10 slightly overlap so the end with the adhesive 12 may be pressed onto the end without the adhesive 12, holding the drum slip 10 in place and securing it to the drum shell 2. Other methods may be used to fasten the ends of the drum slip 10 together to secure the drum slip 10. Other methods include but are not limited to use of hook and loop fasteners, use of one or more tabs formed in one end of the drum slip 10 that are inserted into one or more slots cut into the other end of the drum slip 10, use of an adhesive backing, static electricity, staples, etc.

The drum slip 10 may be made from a variety of flexible materials including but not limited to vinyl, plastics, rubber, paper, laminated paper, fabric, laminated fabric, and other flexible materials or a combination of flexible materials. The drum slip 10 may incorporate images or messages printed on the flexible material or molded or cut into the flexible material, and the drum slip 10 may be made in any color or combination of colors desired by the user. The drum slip 10 may also be transparent.

Installation of the drum slip 10 may be accomplished in just a few minutes, far faster than traditional methods of painting or recovering a drum shell 2. For some drum models, the drum slip 10 may be installed without any disassembly of the drum. To install the drum slip 10, the drum slip 10 is wrapped around the drum shell 2 in the space between the drum shell 2 and the tension rods 5. The openings 11 in the drum slip 10 fit over and around the hardware attached to the drum shell 2. The ends of the drum slip 10 are pulled together so the drum slip 10 fits tightly around the shell 2, and the ends are secured to one another using the adhesive 12.

Figure 3:
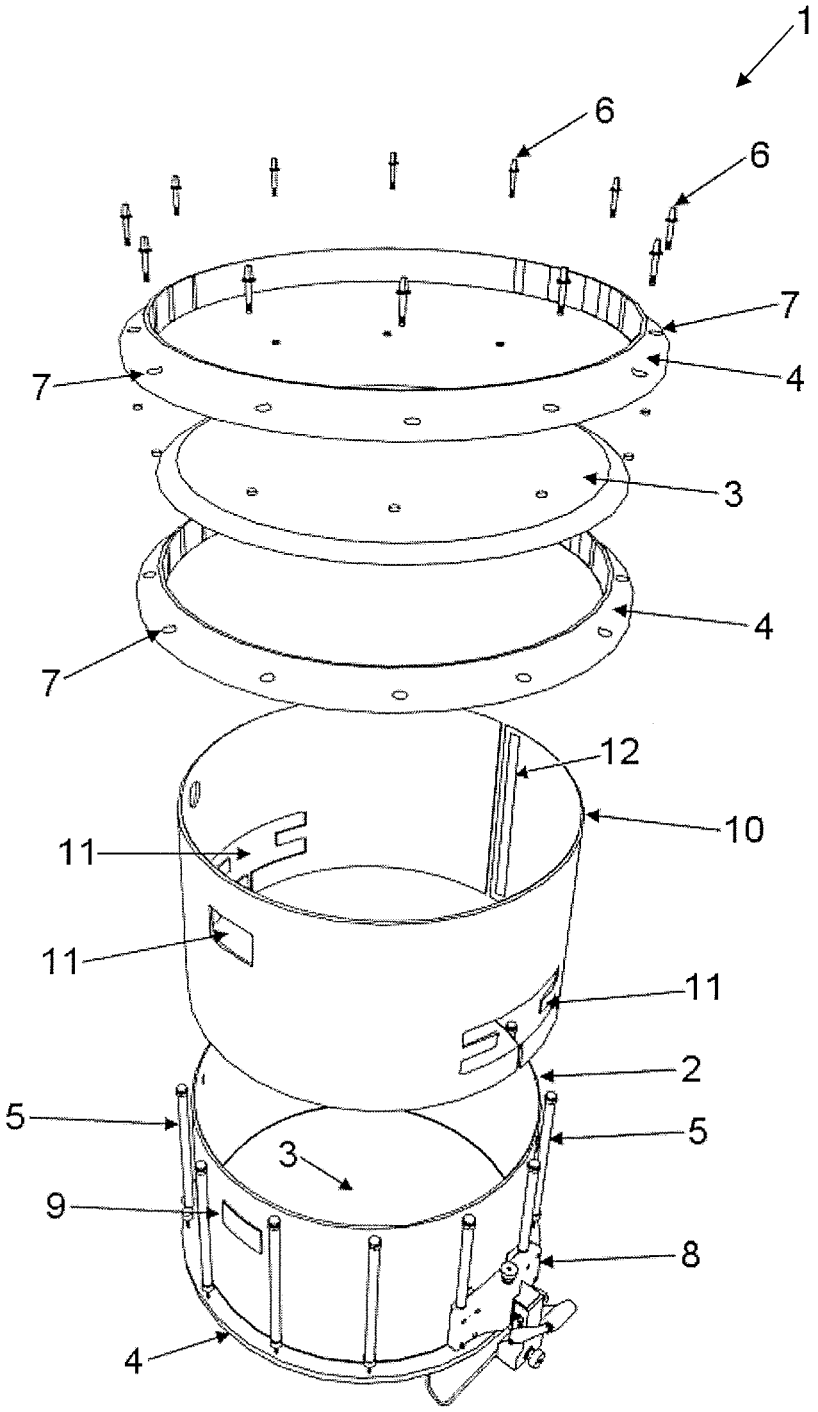
FIG. 3 is a side view of a drum with the drum head and hoops removed to allow installation of the drum slip.

Installation of the drum slip 10 on other models of drum requires removal of one or more drum heads 3 and retaining hoops 4. FIG. 3 is a side view of a drum 1 with the drum head 3 and hoops 4 removed to allow installation of the drum slip 10. To install the drum slip 10, a user loosens the threaded lugs 6 and removes the hoops 4 and head 3. The drum slip 10 is then wrapped around the drum shell 2 in the space between the drum shell 2 and the tension rods 5. The openings 11 in the drum slip 10 fit over and around the hardware attached to the drum shell 2. In FIG. 3, the openings 11 are configured to fit around the snare strainer 8 and manufacturer's emblem 9. The ends of the drum slip 10 are pulled together so the drum slip 10 fits tightly around the shell 2, and the ends are secured to one another using the adhesive 12. The user then places the head 3 and hoops 4 back on the shell 2 and tightens the threaded lugs 6.

Figure 4:
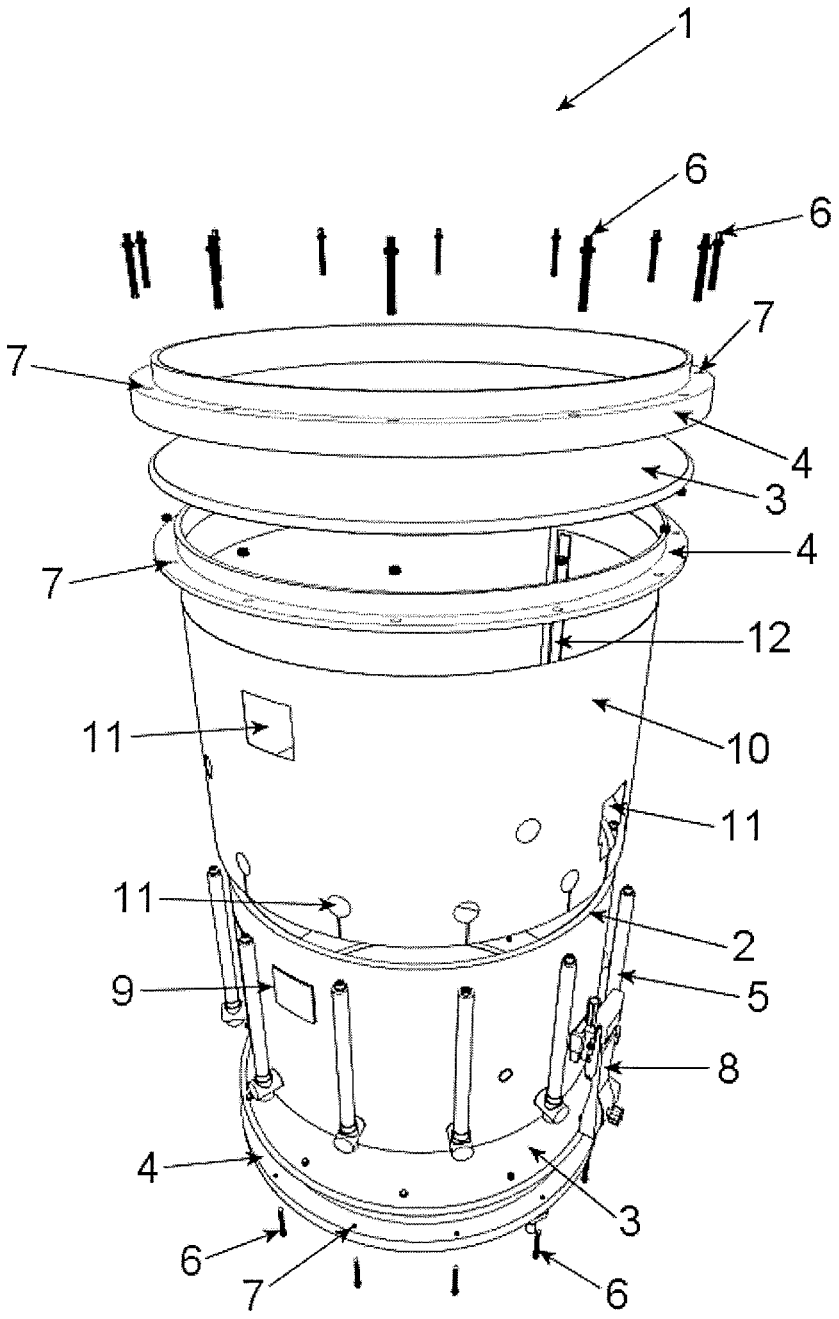
FIG. 4 is a side view of a drum with two drum heads and hoops removed to allow installation of the drum slip.

For other drum models, more than one drum head 3 and retaining hoops 4 must be removed to install the drum slip 10. FIG. 4 is a side view of a drum 1 with two drum heads 3 and hoops 4 removed to allow installation of the drum slip 10. To install the drum slip 10, a user loosens the threaded lugs 6 and removes the hoops 4 and heads 3. The drum slip 10 is then wrapped around the drum shell 2 in the space between the drum shell 2 and the tension rods 5. The openings 11 in the drum slip 10 fit over and around the hardware attached to the drum shell 2 and the snare strainer 8 and manufacturer's emblem 9 that are attached to the shell 2. The ends of the drum slip 10 are pulled together so the drum slip 10 fits tightly around the shell 2, and the ends are secured to one another using the adhesive 12. The user then places the heads 3 and hoops 4 back on the shell 2 and tightens the threaded lugs 6.

Figure 5:
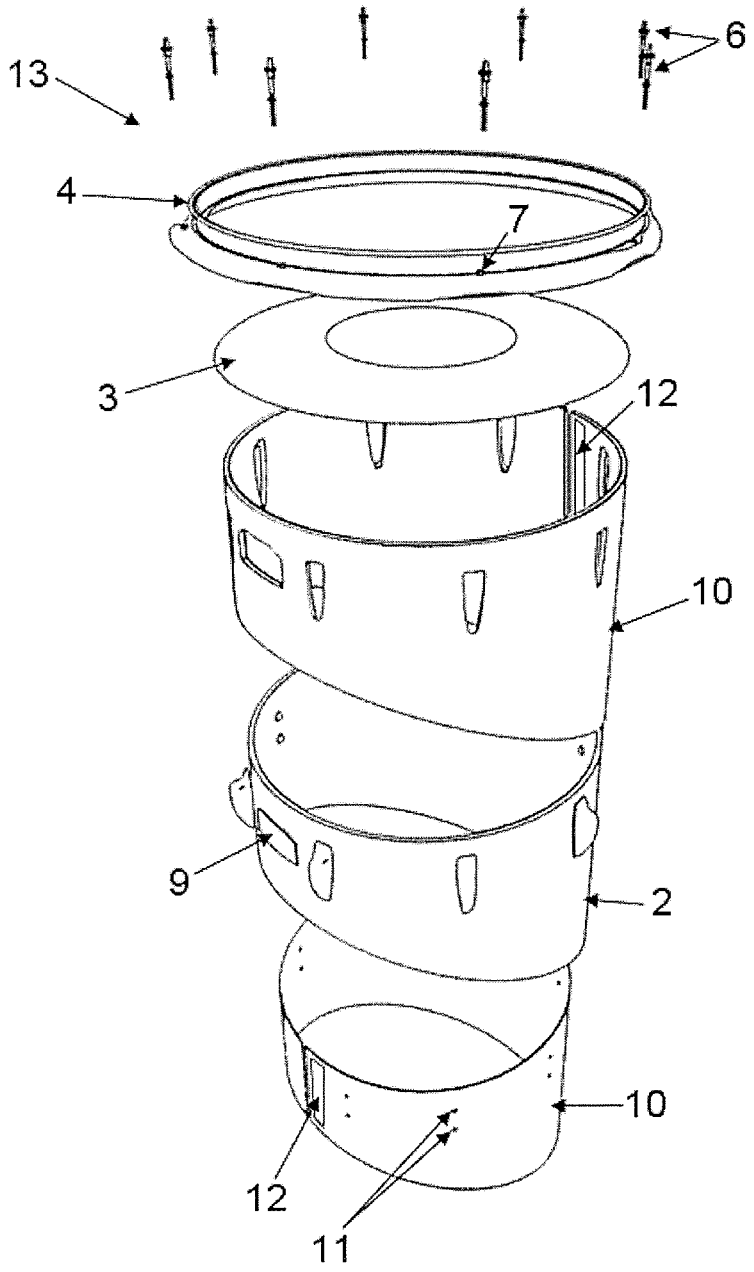
FIG. 5 is a side view of a tenor drum with the head and hoop removed to allow installation of a drum slip on the exterior and interior of the drum shell.

FIG. 5 depicts the installation of a drum slip 10 on the exterior and interior of a tenor drum 13 that has a single head 3 on top and is open on the bottom. To install the drum slip on the exterior of the tenor drum 13, the user loosens the threaded lugs 6 and removes the drum head 3 and hoop 4. The drum slip 10 is wrapped around the drum shell 2 and the ends of the drum slip 10 are secured using the adhesive 12. FIG. 5 also depicts the installation of a drum slip 10 on the interior of the tenor drum 13. To install a drum slip 10 on the interior of a drum 13, the user first removes any detachable hardware, like screws or other threaded fasteners, from the interior of the drum shell 2. The drum slip 10 is wrapped around the interior of the shell 2 and the ends of the drum slip 10 are secured using the adhesive 12. The removeable hardware is then reinstalled, holding the drum slip 10 in place.

The foregoing description of preferred embodiments for the drum slip is presented for the purposes of illustration and description. They are not intended to be exhaustive or to limit the invention to the precise form disclosed. Obvious modifications or variations are possible in light of the above teachings. The embodiments are chosen and described in an effort to provide the best illustration of the principles of the invention and its practical applications, and to thereby enable one of ordinary skill in the art to utilize the invention in various embodiments and with various modifications as are suited to the particular use contemplated. All such modifications and variations are within the scope of the invention as determined by the appended claims when interpreted in accordance with the breadth to which they are fairly, legally, and equitably entitled.

What is claimed is:

1. A method for changing the appearance of a drum shell comprising the steps of:

removing one or more drum heads and one or more retaining hoops;

applying a piece of flexible material having pre-cut openings and having two or more ends onto the drum shell surface allowing any circumferentially spaced hardware attached to the drum shell to protrude through said pre-cut openings in the flexible material; and;

attaching one end of the flexible material to another end of the flexible material, so the material is tightly secured to the drum shell; and reattaching the one or more drum heads and the one or more retaining hoops.

2. The method of claim 1, where the step of attaching one end of the flexible material to another end of the flexible material is accomplished by use of a hook and loop fastener.

3. The method of claim 1, where the step of attaching one end of the flexible material another end of the flexible material is accomplished by use of an adhesive.

4. The method of claim 1, where the step of attaching one end of the flexible material to another end of the flexible material is accomplished by inserting one or more tabs cut into one end of the material that into corresponding slots cut into another end of the material.

5. A method for changing the appearance of a drum shell having a interior surface and a exterior surface, comprising the steps of:

removing fasteners and hardware attached to the interior of a drum shell;

inserting a piece of flexible material having two or more ends around the interior of the drum shell, where the flexible material is pre-cut to fit around apertures in the drum shell and around hardware attached to the drum shell;

attaching one end of the flexible material to another end of the flexible material, so the material is tightly wrapped around the drum shell; and reattaching the fasteners and hardware.

6. The method of claim 5, where the step of attaching one end of the flexible material to another end of the flexible material is accomplished by use of a hook and loop fastener.

7. The method of claim 5, where the step of attaching one end of the flexible material to another end of the flexible material is accomplished by use of an adhesive.

8. The method of claim 5, where the step of attaching one end of the flexible material to another end of the flexible material is accomplished by inserting one or more tabs cut into one end of the material into corresponding slots cut into another end of the material.

* * * * *